US005686236A

United States Patent [19]

Lok et al.

[11] Patent Number: 5,686,236

[45] Date of Patent: Nov. 11, 1997

[54] PHOTOGRAPHIC ELEMENT CONTAINING NEW GOLD (I) COMPOUNDS

[75] Inventors: Roger Lok, Rochester; Weimar Weatherly White, Canaseraga, both of N.Y.

[73] Assignee: Eastman Kodak Company, Rochester, N.Y.

[21] Appl. No.: 778,330

[22] Filed: Jan. 2, 1997

Related U.S. Application Data

[60] Division of Ser. No. 672,718, Jun. 28, 1996, Pat. No. 5,620,841, which is a continuation-in-part of Ser. No. 616, 978, Mar. 18, 1996, abandoned and Provisional application No. 60/001,680, Jul. 31, 1995.

[51] Int. Cl.[6] ..... G03C 1/09; C07F 1/12

[52] U.S. Cl. ..... 430/600; 430/603; 430/605; 556/113

[58] Field of Search ..... 430/600, 603, 430/605; 556/113

[56] References Cited

U.S. PATENT DOCUMENTS

| | | | |
|---|---|---|---|
| 3,503,749 | 3/1970 | Tavenier et al. . | |
| 4,165,380 | 8/1979 | Hill | 424/290 |
| 4,198,240 | 4/1980 | Mikawa | 430/570 |
| 4,276,374 | 6/1981 | Mifune et al. | 430/611 |
| 4,906,558 | 3/1990 | Mucke et al. | 430/603 |
| 4,960,689 | 10/1990 | Nishikawa et al. | 430/603 |
| 5,001,042 | 3/1991 | Hasebe | 430/382 |
| 5,009,992 | 4/1991 | Friedrich et al. | 430/573 |
| 5,017,468 | 5/1991 | Joly et al. | 430/569 |
| 5,043,256 | 8/1991 | Otani | 430/550 |
| 5,043,259 | 8/1991 | Arai | 430/596 |
| 5,049,485 | 9/1991 | Deaton | 430/605 |
| 5,081,009 | 1/1992 | Tanemura et al. | 430/569 |
| 5,104,784 | 4/1992 | Shuto et al. | 430/567 |
| 5,110,719 | 5/1992 | Shuto et al. | 430/569 |
| 5,185,241 | 2/1993 | Inoue | 430/598 |
| 5,229,263 | 7/1993 | Yoshida et al. | 430/600 |
| 5,252,455 | 10/1993 | Deaton | 430/605 |
| 5,266,442 | 11/1993 | Ooms | 430/265 |
| 5,283,169 | 2/1994 | Goto | 430/603 |
| 5,292,635 | 3/1994 | Lok | 430/611 |
| 5,620,841 | 4/1997 | Lok et al. | 430/600 |

FOREIGN PATENT DOCUMENTS

| | | | |
|---|---|---|---|
| 0 457 298 A1 | 5/1991 | European Pat. Off. | G03C 1/08 |
| 0 514 675 A1 | 11/1992 | European Pat. Off. | G03C 1/09 |
| 0 2189541-A | 1/1989 | Japan | G03C 1/28 |
| 0 3200-542-A | 9/1989 | Japan | G03C 1/06 |
| 05313282-A | 4/1991 | Japan | G03C 1/08 |
| 05053234-A | 8/1991 | Japan | G03C 1/09 |
| 06242536-A | 12/1992 | Japan | G03C 1/07 |
| 5-113617 | 5/1993 | Japan | G03C 1/09 |

OTHER PUBLICATIONS

"Gold(1) Complexes of Unidentate and Bidentate Phosphorus–, Arsenic–, Antimony–, and Sulphur–donor Ligands" by C. McAuliffe, et al., 1979, pp. 1730–1735.

"Photographic Printing in Colloidal Gold" by M.J. Ware, pp. 157–161.

*Primary Examiner*—Mark F. Huff

*Attorney, Agent, or Firm*—Sarah Meeks Roberts

[57] ABSTRACT

A photographic element comprising a support having situated thereon a silver halide emulsion layer, said emulsion layer comprising a compound of the formula:

$$Z—SO_2S—Au(I)—SQ \quad (I)$$

wherein

Z represents an alkyl, aryl, or heterocyclic group; and

Q represents an aryl or heterocyclic group.

2 Claims, No Drawings

PHOTOGRAPHIC ELEMENT CONTAINING NEW GOLD (I) COMPOUNDS

CROSS-REFERENCE TO RELATED APPLICATIONS

This is a Divisional of application Ser. No. 08/672,781, filed Jun. 28, 1996, now U.S. Pat. No. 5,620,841 which is a continuation-in-part application of U.S. Provisional Application Ser. No. 60/001,680, filed Jul. 31, 1995, and U.S. Ser. No. 08/616,978, filed Mar. 18, 1996, now abandoned both entitled "PHOTOGRAPHIC ELEMENT CONTAINING NEW GOLD(I) COMPOUNDS".

FIELD OF THE INVENTION

This invention relates to new gold(I) compounds comprising a thiosulfonate containing ligand, and to photographic elements containing such compounds.

BACKGROUND OF THE INVENTION

For more than a century, it has been known that certain materials are sensitive to actinic radiation and, upon exposure to such radiation, form latent images capable of being subsequently developed into useful visible images. Almost exclusively, commercial application of these radiation sensitive materials has been the domain of silver halides which exhibit superior sensitivity to light over other radiation sensitive materials, some of which have been known for as long as silver halides have been in use. Such superior sensitivity has made silver halides more practical for use in cameras and other photographic equipment since they can be utilized in low light situations, or in situations where the mechanical characteristics of a camera (or other exposure means) would interfere with an optimum exposure.

Despite their superior sensitivity to light, there nevertheless has been considerable effort devoted to improving the sensitivity of silver halide crystals, and hence the photographic elements in which they are contained. In this regard, photographic chemists have attempted to vary the processes for making, or the components within, silver halide emulsions. One particularly preferred means by which to improve sensitivity has been to chemically sensitize photographic emulsions with one or more compounds containing labile atoms of gold, sulfur, selenium or the like. Examples of chemically sensitized photographic silver halide emulsion layers are described in, for example, *Research Disclosure*, Item No. 308119, December 1989, Section III, and the references listed therein. (*Research Disclosure* is published by Kenneth Mason Publications Ltd, Dudley Annex, 12a North Street, Emsworth, Hampshire PO 10 7DQ, England.)

Among the gold(I) chemical sensitizers known in the industry, trisodium aurous dithiosusulfate is often cited as being advantageous. This compound, however, is not universally applicable to all emulsion systems because of certain disadvantages it provides. In particular, trisodium aurous dithiosulfate contains two thiosulfate ions that are bonded to gold. These ions may undergo sulfur sensitization reactions in addition to the gold sensitization reactions in the emulsion. Therefore, this gold(I) compound is not appropriate in silver halide compositions in which a ratio of sulfur to gold of less than 2:1 is desired for chemical sensitization, and not appropriate in silver halide compositions in which sulfur or selenium sensitizers other than thiosulfate are desired.

Other known gold(I) chemical sensitizers include aurous sulfides and the gold(I) thiolate compounds as described in Tavenier et al., U.S. Pat. No. 3,503,749. With respect to the former, although relatively easy to manufacture, they have been known to provide considerable sensitization variability and thus more predictable alternatives are desired. With respect to the latter compounds, they contain a sulfonic acid substituent on the thiolate ligand to impart water solubility. Further, they require the use of gold fulminate in their manufacture, a compound that is dangerously explosive and thus not desirable for practical use.

In Deaton, U.S. Pat. No. 5,049,485, a new class of gold(I) compounds comprising mesoionic ligands is described. Specifically, gold(I) compounds are described which contain one or two mesoionic substituents bound directly to a gold atom. The compounds are also positively charged, and thus must be associated with an appropriate anion, typically a halogen or tetrafluoroborate.

The compounds described in U.S. Pat. No. 5,049,485 are advantageous in that they provide gold(I) sensitization without many of the disadvantages inherent in the use of the aforementioned gold(I) compounds. However, they have been known to exhibit limited stability in solution or dispersion. Further, at certain levels and under certain photographic conditions, they can cause an undesirable increase in fog.

It would thus be desirable to identify alternative gold(I) compounds that can provide chemical sensitization without a concurrent and substantial rise in fob levels. These compounds should be stable in solution or dispersion and should be suitable for multiple types of emulsion systems. Further, they should be readily synthesizable in the absence of dangerous reactants.

SUMMARY OF THE INVENTION

The present invention provides new gold(I) compounds of the formula below. It also provides a photographic element comprising a support having situated thereon a silver halide emulsion layer, said emulsion layer comprising a gold(I) compound of the formula:

$$Z—SO_2S—Au(I)—SQ \quad (I)$$

wherein

Z represents an alkyl, aryl, or heterocyclic group; and

Q represents an aryl or heterocyclic group.

The invention provides the opportunity to achieve chemical sensitization in various types of silver, halide photographic elements by use of a new type of gold(I) compound. The gold(I) compound offers improved stability over prior known gold(I) compounds. It further provides the opportunity to achieve chemical sensitization without a concurrent and substantial rise in fog.

DETAILED DESCRIPTION OF THE INVENTION

In accordance with the invention, a photographic element is provided which comprises a gold(I) compound of the formula:

$$Z—SO_2S—Au(I)—SQ \quad (I)$$

wherein

Z represents an alkyl, aryl, or heterocyclic group; and

Q represents an aryl or heterocyclic group. Preferably, Q represents a heterocyclic group. More preferably, it is a heterocyclic group which, when combined with the sulfur atom to which it is attached is a zwitterionic group.

By alkyl, aryl, or heterocyclic group, in either the description of Z or Q, it is meant such groups as defined in accordance with the definitions set forth in Grant and Hackh's Chemical Dictionary, fifth ed., Mcgraw-Hill 1987, and in accordance with general rules of chemical nomenclature.

Exemplary alkyl groups include methyl, ethyl, propyl, butyl, pentyl, hexyl, octyl, nonyl, decyl, dodecyl, hexadecyl, octadecyl, isopropyl, and t-butyl. Preferably, the alkyl groups have from 1 to 5 carbon atoms, although groups having as many as 20 carbon atoms or more are specifically contemplated.

Exemplary aryl groups include phenyl, tolyl, naphthyl, biphenyl, azulenyl, anilinyl, and anisidinyl. It is preferred that such groups have from 6 to 20 carbon atoms. More preferred are groups selected from phenyl, tolyl, and naphthyl.

Exemplary heterocyclic groups (which include heteroaryl groups) include pyrrolyl, furanyl, tetrahydrofuranyl, pyridinyl, picolinyl, piperidinyl, morpholinyl, thiadiazolyl, thiatriazolyl, benzothiazolyl, benzoxazolyl, benzimidizolyl, benzoselenozolyl, benzotriazolyl, indazolyl, quinolinyl, quinaldinyl, pyrrolidinyl, thiophenyl, oxazolyl, thiazolyl, imidazolyl, selenazolyl, tellurazolyl, triazolyl, tetrazolyl, and oxadiazolyl. It is preferred that the heterocyclic groups be selected from triazolyl, tetrazolyl and thiazolyl.

Each of the above groups may be substituted with other groups, such groups being readily determinable by those skilled in the art for providing the advantages of the invention. Groups suitable for substitution on each include alkyl and alkylene groups (for example, methyl, ethyl, ethylene, hexyl, hexylene), fluoroalkyl groups (for example, trifluoromethyl), alkoxy groups (for example, methoxy, ethoxy, octyloxy), aryl groups (for example, phenyl, naphthyl, tolyl), hydroxy groups, halogen groups, aryloxy groups (for example, phenoxy), alkylthio groups (for example, methylthio, butylthio), arylthio groups (for example, phenyithio), acyl groups (for example, acetyl, propionyl, butyryl, valeryl), sulfonyl groups (for example, methylsulfonyl, phenylsulfonyl), acylamino groups, sulfonylamino groups, acyloxy groups (for example, acetoxy, benzoxy), carboxy groups, cyano groups, sulfo groups, and amino groups.

In a preferred embodiment of the invention, the Gold(I) compound is of the formula:

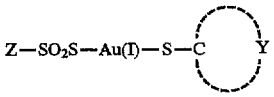

(II)

wherein Z is as defined above, and Y represents the atoms necessary for forming a 5 to 18 atom heterocyclic group. The heterocyclic group, when combined with the sulfur atom to which it is attached, is more preferably a zwitterionic group.

It is preferred that the compound contain a zwitterionic group, typically for —SQ, because synthesis of the present compound preferably begins with a compound as described in Deaton, U.S. Pat. No. 5,049,485, such patent being incorporated herein by reference. The Gold(I) compounds of this patent contain at least one, and typically two, mesoionic ligands of, for example, the formula:

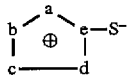

wherein the + sign with a circle around it in the heterocyclic ring symbolizes six delocalized π electrons associated with a positive charge on the heterocyclic ring. The a, b, c, d, and e represent the unsubstituted or substituted atoms necessary to complete the mesoionic compound, for example the carbon and nitrogen atoms necessary to complete a mesoionic triazolium or tetrazolium 5-member heterocyclic ring. The members of the heterocyclic ring (a, b, c, d, and e) may be CR or NR' groups or chalcogen atoms. The minus sign indicates two additional electrons on the exocyclic group $S^-$ which are conjugated with the six π electrons on the heterocyclic ring. It is understood that there is extensive delocalization. The groups R and R' may be hydrogen atoms, substituted or unsubstituted alkyl, aryl, or heterocyclic groups, or R and R' may link together by bonding to form another ring. It is through the exocyclic group S' that the mesoionic compound coordinates to gold (I).

In the present invention, a preferred method of synthesis requires that the gold(I) compounds of U.S. Pat. No. 5,049,485 be reacted with a thiosulfonate ligand having a stronger affinity for the gold(I) atom than one of the mesoionic groups. Such a thiosulfonate ligand effectively displaces one of the mesoionic groups thus forming a compound as utilized in the present invention.

It is also contemplated, however, that one of the reactants for the gold(I) compounds utilized in the present invention be an aurous thiosulfonate complex having as a second ligand on the gold(I) atom a group having a weaker affinity for the gold(I) atom than that of the thiosulfonate ligand. This weaker affinity ligand, under certain synthetic conditions, could be readily displaced by a non-zwitterionic or zwitterionic ligand having a greater affinity for the gold(I) atom. This ligand, however, would be expected to have a weaker affinity for the gold(I) atom than that of the thiosulfonate ligand. Otherwise, the thiosulfonate ligant might also be displaced.

When the gold(I) compounds utilized in the invention comprise a non-zwitterionic ligand in addition to the thiosulfonate ligand, the compounds will be associated with a cation so as to balance their charge. Suitable cations include sodium and potassium ions.

The preferred gold(I) compounds are of the formula:

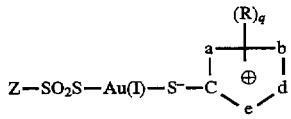

(III)

wherein

Z is as defined above;

a, b, d, and e represent atoms necessary to complete the heterocyclic group and are independently selected from carbon, nitrogen or chalcogen atoms, at least one of a, b, d, or e being nitrogen;

R is independently hydrogen or an alkyl, aryl, or heterocyclic group, preferably hydrogen or an alkyl or aryl group having from 1 to 8 carbon atoms; and q is from 1 to 4, preferably 2 or 3.

It is to be understood in such a compound that a balancing charge to the sulfur atom's negative charge is associated with the heterocyclic ring as represented by a, b, c, d and e (and is represented by the + charge with a circle around it in the heterocyclic group). Thus, the heterocycle, in combination with the sulfur to which it is bound, represents a zwitterionic group as described above.

In a more preferred embodiment of the invention, the gold(I) compound is of the formula:

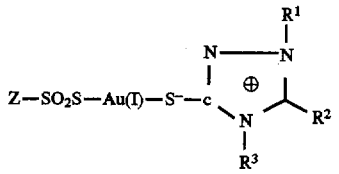

(IV)

wherein Z is as defined above, and $R^1$, $R^2$, and $R^3$ are independently selected from hydrogen or an alkyl group having from 1 to 5 carbon atoms. Again, the heterocycle and sulfur atom are taken together to be a zwitterionic group, with the positive charge, in this instance, residing one of the nitrogen atoms.

Representative examples of the gold(I) compounds utilized in the invention are indicated below. The invention is not to be construed as being limited to these examples.

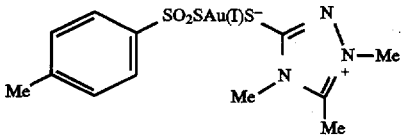

(A)

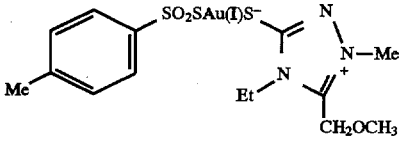

(B)

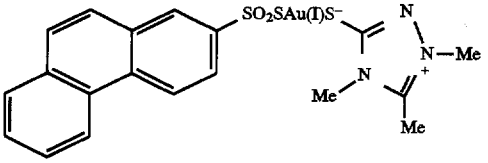

(C)

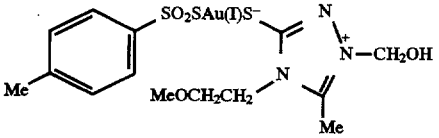

(D)

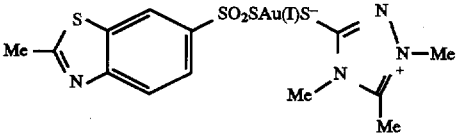

(E)

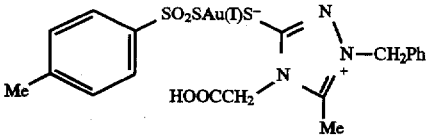

(F)

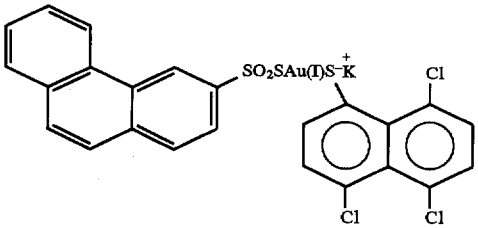

(G)

-continued

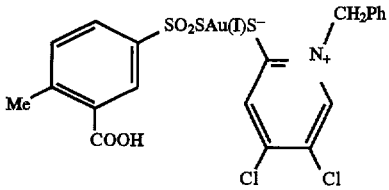

(H)

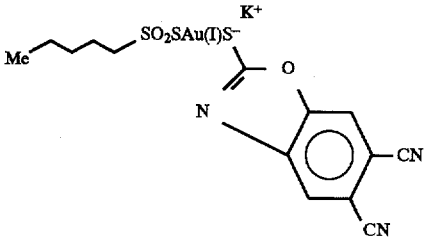

(I)

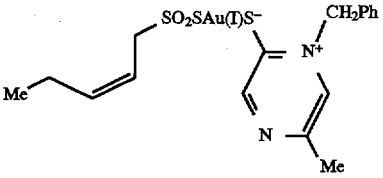

(J)

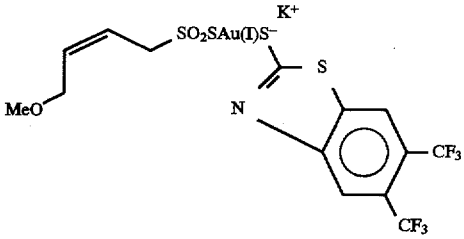

(K)

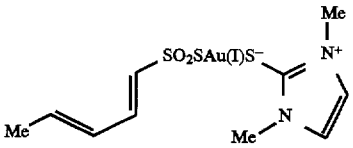

(L)

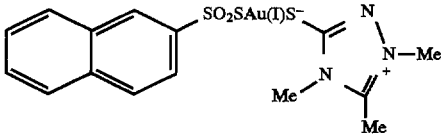

(M)

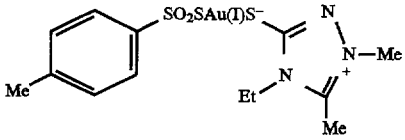

(N)

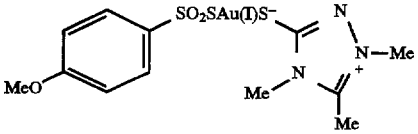

(O)

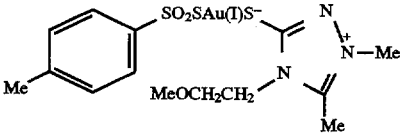

(P)

-continued (Q)

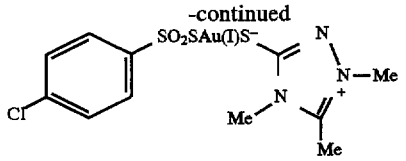

(R)

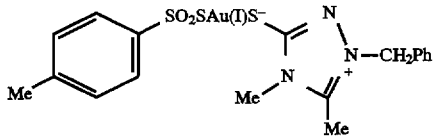

(S)

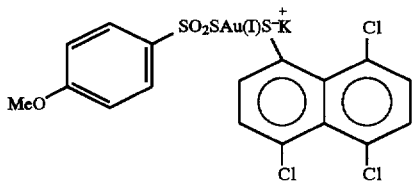

(T)

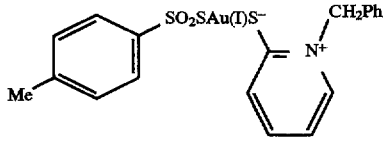

(U)

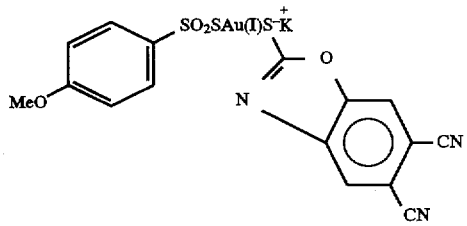

(V)

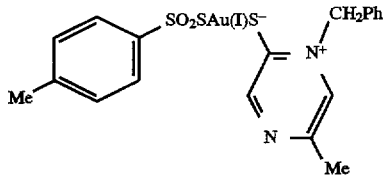

(W)

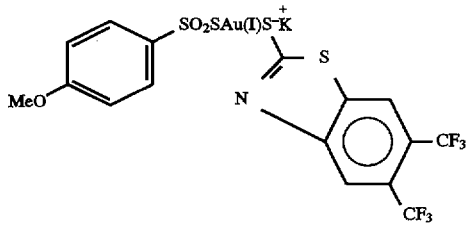

(X)

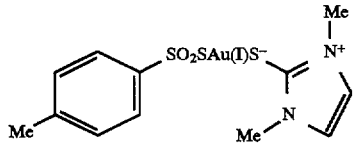

In the practice of the present invention, the silver halide emulsion layer comprising the gold(I) compound may be comprised of any halide distribution. Thus, it may be comprised of silver chloride, silver bromide, silver bromochloride, silver chlorobromide, silver iodochloride, silver iodobromide, silver bromoiodochloride, silver chloroiodobromide, silver iodobromochloride, and silver iodochlorobromide. It is preferred, however, that the emulsion be a predominantly silver chloride emulsion. By predominantly silver chloride, it is meant that the grains of the emulsion are greater than about 50 mole percent silver chloride. Preferably, they are greater than about 75 mole percent silver chloride; more preferably greater than about 90 mole percent silver chloride; and optimally greater than about 95 mole percent silver chloride.

The silver halide emulsion employed in the practice of the invention can contain grains of any size and morphology. Thus, the grains may take the form of cubes, octahedrons, cubo-octahedrons, or any of the other naturally occurring morphologies of cubic lattice type silver halide grains. Further, the grains may be irregular such as spherical grains or tabular grains. Particularly preferred are grains having a tabular or cubic morphology.

The photographic emulsions employed in this invention are generally prepared by precipitating silver halide crystals in an aqueous colloidal medium (matrix) by methods known in the art. The colloid is typically a hydrophilic film forming agent such as gelatin, alginic acid, or derivatives thereof.

The crystals formed in the precipitation step are washed and then chemically and spectrally sensitized by adding spectral sensitizing dyes and chemical sensitizers, and by providing a heating step during which the emulsion temperature is raised, typically from 40° C. to 70° C., and maintained for a period of time. The precipitation and spectral and chemical sensitization methods utilized in, preparing the emulsions employed in the invention can be those methods known in the art.

Chemical sensitization of the emulsion typically employs sensitizers such as: reducing agents, e.g., polyamines and stannous salts; noble metal compounds, e.g., gold, platinum; and polymeric agents, e.g., polyalkylene oxides. As described, heat treatment is employed to complete chemical sensitization. Spectral sensitization is effected with a combination of dyes, which are designed for the wavelength range of interest within the visible or infrared spectrum. It is known to add such dyes both before and after heat treatment.

After sensitization, the emulsion is coated on a support. Coating techniques known in the art include dip coating, air knife coating, curtain coating and extrusion coating.

The gold(I) compounds can be added to the emulsion at any time, such as during the grain growth, during or before chemical sensitization or during final melting and co-mixing of the emulsion and additives for coating. It is preferred that the compounds be added after precipitation of the grains and most preferred that they be added before or during the heat treatment of the chemical sensitization step.

The gold(I) compounds can be introduced to the emulsion at the appropriate time by any means commonly practiced in the art such as by a gel dispersion. They may be added to the vessel containing the aqueous gelatin salt solution before the start of the precipitation, or to a salt solution during precipitation. Other modes are also contemplated. Temperature, stirring, addition rates and other precipitation factors may be set within conventional ranges, by means known in the art, so as to obtain the desired physical characteristics.

A suitable level for the Gold(I) compounds is from about 0.0001 to about 10 mmole/mole silver, depending upon the particular properties of the silver halide emulsion in which it is incorporated. A preferred level is from about 0.001 to about 1 mmole/mole silver. A more preferred level is from about 0.01 to about 0.1 mmole/mole silver; and an optimal level is about 0.05 mmole/mole silver.

In the following Table, reference will be made to (1)*Research Disclosure*, December 1978, Item 17643, (2)*Research Disclosure*, December 1989, Item 308119, and (3)*Research Disclosure*, September 1994, Item 36544, all published by Kenneth Mason Publications, Ltd., Dudley Annex, 12a North Street, Emsworth, Hampshire PO10 7DQ, ENGLAND, the disclosures of which are incorporated herein by reference. The Table and the references cited in the Table are to be read as describing particular components suitable for use in the elements of the invention. The Table and its cited references also describe suitable ways of preparing, exposing, processing and manipulating the elements, and the images contained therein.

| Reference | Section | Subject Matter |
|---|---|---|
| 1 | I, II | Grain composition, morphology |
| 2 | I, II, IX, X, XI, XII, XIV, XV | and preparation. Emulsion preparation including hardeners, coating aids, addenda, etc. |
| 3 | I,II,III,IX A & B | |
| 1 | III, IV | Chemical sensitization and |
| 2 | III, IV | spectral sensitization/ |
| 3 | IV, V | desensitization |
| 1 | V | UV dye, optical brighteners, |
| 2 | V | lumninescent dyes |
| 3 | VI | |
| 1 | VI | Antifoggants and stabilizers |
| 2 | VI | |
| 3 | VII | |
| 1 | VIII | Absorbing and scattering |
| 2 | VIII, XIII XVI | materials; Antistatic layers; matting agents |
| 3 | VIII,IX C & D | |
| 1 | VII | Image-couplers and image- |
| 2 | VII | modifying couplers; Dye |
| 3 | X | stabilizers and hue modifiers |
| 1 | XVII | Supports |
| 2 | XVII | |
| 3 | XV | |
| 3 | XI | Specific layer arrangements |
| 3 | XII, XIII | Negative working emulsions; Direct positive emulsions |
| 2 | XVIII | Exposure |
| 3 | XVI | |
| 1 | XIX, XX | Chemical processing; |
| 2 | XIX, XX, XXII | Developing agents |
| 3 | XVIII, XIX, XX | |
| 3 | XIV | Scanning and digital processing procedures |

The photographic elements can be incorporated into exposure structures intended for repeated use or exposure structures intended for limited use, variously referred to as single use cameras, lens with film, or photosensitive material package units.

The photographic elements can be exposed with various forms of energy which encompass the ultraviolet, visible, and infrared regions of the electromagnetic spectrum as well as with electron beam, beta radiation, gamma radiation, x-ray, alpha particle, neutron radiation, and other forms of corpuscular and wave-like radiant energy in either noncoherent (random phase) forms or coherent (in phase) forms, as produced by lasers. When the photographic elements are intended to be exposed by x-rays, they can include features found in conventional radiographic elements.

The photographic elements are preferably exposed to actinic radiation, typically in the visible region of the spectrum, to form a latent image, and then processed to form a visible image, preferably by other than heat treatment. Processing is preferably carried out in the known RA-4™ (Eastman Kodak Company) developing solutions. 20 Synthetic Example The following example illustrates the synthesis of a gold(I) compound useful in the present invention. The synthesis described is representative and can be readily varied by those skilled in the art to obtain other useful gold(I) compounds.

In 200 ml water, 2000 mg of compound 1 of Deaton, U.S. Pat. No. 5,049,485 were dissolved. The solution was heated to 70° C. and stirred. To the solution, a filtered second solution of 720 mg (90% of optimum level) of tolylthiosulfonate potassium salt and 72 mg of tolylsulfinate sodium salt dissolved in 50 ml of water was added. The combined solutions were stirred and cooled to room temperature. During this step, crystals precipitated, which were suction filtered onto a glass filter, washed with 200 ml of water, and suction dryed. Continued drying of the crystals was done at 50° C. until a constant weight was obtained.

The yield of the above precipitate was 1.25 grams (expected: 1.67 grams). Infrared and x-ray diffraction analysis showed the precipitate to contain a compound consistent with Compound (A). Elemental analysis determined the compound to have the following component profile (theoretical values are shown parenthetically): N=7.99% (7.97%); C=27.17% (27.33%); H=3.02% (3.06%); Au=37140% (37.34%); S=17.83% (18.24%); O=6.59% by difference (6.07%).

EXAMPLES

The practice of the invention is described in detail below with reference to specific illustrative examples, but the invention is not to be construed as being limited thereto.

Example 1

Various amounts of a dispersion of the gold(I) compound prepared above or a comparative compound (as shown in Table I) were added directly, or in a gelatin dispersion, to a series of 0.3 mole tabular [100] grain negative silver chloride emulsions at 40° C. The emulsions were held for 10 minutes. A blue spectral sensitizing dye, anhydro-5-chloro-3,3'-di(3-sulfopropyl) naphtho[1,2-d] thiazolothiacyanine hydroxide triethylammonium salt (550 mg/Ag mol) was then added to the emulsions which were stirred for 20 minutes. The emulsions were heated to 60° C., held for 40 minutes, and then cooled to 40° C. A solution of 1-(3-acetamidophenyl)-5-mercaptotetrazole (100 mg/Ag mol) was added and the emulsions chilled and readied for coating. The emulsions further contained a yellow dye-forming coupler alpha-(4-(4-benzyloxy-phenyl-sulfonyl)phenoxy)-alpha(pivalyl)-2-chloro-5-(gamma-(2,4-di-5-amylphenoxy) butyramido)acetanilide (1.08 g/m$^2$) in di-n-butylphthalate coupler solvent (0.27 g/m$^2$), and gelatin (1.51 g/m$^2$). The emulsions (0.34, g Ag/m$^2$) were coated on a resin coated paper support and a 1.076 g/m$^2$ gel overcoat was applied as a protective layer along with the hardener bis(vinylsulfonyl) methyl ether in an amount of 1.8% of the total gelatin weight.

The coatings were given a 0.1 second exposure, using a 0–3 step tablet (0.15 increments) with a tungsten lamp designed to stimulate a color negative print exposure source. This lamp had a color temperature of 3000 K., log lux 2.95, and the coatings were exposed through a combination of magenta and yellow filters, a 0.3 ND (Neutral Density), and a UV filter. The processing consisted of a color development (45 sec, 35° C.), bleach-fix (45 sec, 35° C.) and stabilization or water wash (90 sec, 35° C.) followed by drying (60 sec, 60° C.). The chemistry used in the processor consisted of the following solutions:

| | |
|---|---|
| Developer: | |
| Lithium salt of sulfonated polystyrene | 0.25 mL |
| Triethanolamine | 11.0 mL |
| N,N-diethylhydroxylamine (85% by wt.) | 6.0 mL |
| Potassium sulfite (45% by wt.) | 0.5 mL |
| Color developing agent (4-(N-ethyl-N-2-methanesulfonyl aminoethyl) -2-methyl-phenylenediaminesesquisulfate monohydrate | 5.0 g |
| Stilbene compound stain reducing agent | 2.3 g |
| Lithium sulfate | 2.7 g |
| Acetic acid | 9.0 mL |
| Water to total 1 liter, pH adjusted to 6.2 | |
| Potassium chloride | 2.3 g |
| Potassium bromide | 0.025 g |
| Sequestering agent | 0.8 mL |
| Potassium carbonate | 25.0 g |
| Water to total of 1 liter, pH adjusted to 10.12 | |
| Bleach-fix | |
| Ammonium suifite | 58.0 g |
| Sodium thiosulfate | 8.7 g |
| Ethylenediaminetetracetic acid ferric ammonium salt | 40.0 g |
| Stabilizer | |
| Sodium citrate | 1.0 g |
| Water to total 1 liter, pH adjusted to 7.2 | |

Speed and fog data were determined for each of the coatings and are shown below in Table I. Speed was measured at 1.0 density units above Dmin and represents fresh sensitivity. Fog was measured as fresh fog and represents the minimum density (Dmin) above zero. All amounts of the gold(I) and comparative compounds are shown in μmol/Ag mol. The structures of comparative compounds utilized in the Examples of Table I are shown following Table I.

TABLE I

| Sample | Compound | Amount | Speed | Fog |
|---|---|---|---|---|
| 1 (comparison) | none | 0 | 133 | 0.082 |
| 2 (invention) | A | 2.35 | 154 | 0.266 |
| 3 (invention) | A | 2.94 | 142 | 0.315 |
| 4 (comparison) | C-1 | 2.35 | 122 | 0.075 |
| 5 (comparison) | C-1 | 2.94 | 121 | 0.078 |
| 6 (comparison) | C-2 | 2.35 | 121 | 0.082 |
| 7 (comparison) | C-2 | 2.94 | 118 | 0.076 |
| 8 (comparison) | C-3 | 2.35 | 177 | 0.627 |
| 9 (comparison) | C-3 | 2.94 | 153 | 0.585 |

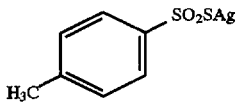

C-1

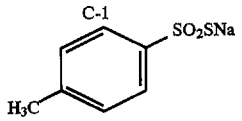

C-2

TABLE I-continued

| Sample | Compound | Amount | Speed | Fog |
|---|---|---|---|---|

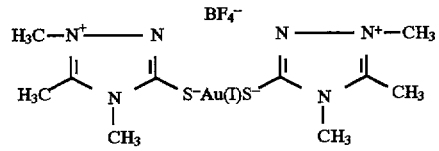

C-3

(Compound 1 of U.S. Pat. No. 5,049,485)

As can be seen in Table I, the gold(I) compounds of the invention provide tabular silver chloride grain emulsions with improved sensitivity with only a limited increase in fog. The comparative compounds either do not provide such improved sensitivity, or do so with a substantial and deleterious increase in fog.

Example 2

A series of 0.3 mole cubic iodochloride emulsions incorporating various amounts of the Au(I) gold compound prepared in a gelatin dispersion as in Example 1, or comparative compounds were prepared at 40° C. The emulsions were stirred for 6 minutes. The emulsions were then heated to 60° C. and held for 16 minutes. A blue spectral sensitizing dye, anhydro-5-chloro-3,3'-di(3-sulfopropyl)5'-(1-pyrrolyl-thiazolothiacyanine hydroxide triethylammonium salt (306 mg/Ag mol) was added and the emulsions stirred for 19 minutes. A solution of 1-(3-acetamidophenyl)-5-mercaptotetrazole (87 mg/Ag mol) was then added to each emulsion. After another 10 minutes of stirring, the emulsions were allowed to cool to 40° C., at which time the pH was adjusted to 4.9 with sodium hydroxide. The emulsions further contained a yellow dye-forming coupler alpha-(4-(4-benzyloxy-phenyl-sulfonyl)phenoxy)-alpha(pivalyl)-2-chloro-5-(gamma-(2,4-di-5-amylphenoxy)butyramido) acetanilide (1.08 g/m$^2$) in di-n-butylphthalate coupler solvent (0.27 g/m$^2$), and gelatin (1.51 g/m$^2$). The emulsions (0.34 g/Ag/m$^2$) were coated on a resin coated paper support and a 1.076 g/m$^2$ gel overcoat was applied as a protective layer along with the hardener bis(vinylsulfonyl) methyl either in an amount of 1.8% of the total gelatin weight.

The coatings were exposed and processed as in Example 1. Speed and fog were measured as in Example 1 and are shown below in Table II. Amounts are shown in Table II in μmol/Ag mol.

TABLE II

| Sample | Compound | Amount | Speed | Fog |
|---|---|---|---|---|
| 10 (comparison) | none | 0 | 84 | 0.061 |
| 11 (invention) | A | 192 | 140 | 0.074 |
| 12 (invention) | A | 240 | 139 | 0.079 |
| 13 (comparison) | C-3 | 192 | 108 | 0.191 |
| 14 (comparison) | C-3 | 240 | 133 | 0.453 |

As with the tabular silver chloride emulsions of Example 1, cubic silver chloride emulsions containing the gold(I) compounds of the invention show improved sensitivity with only a limited increase in fog.

The invention has been described in detail with particular reference to the preferred embodiments thereof, but it will be understood that variations and modifications can be effected within the scope of the invention.

What is claimed is:
1. A compound of the formula:
$$Z—SO_2S—Au(I)—SQ \quad (I)$$
wherein
Z represents an alkyl, aryl, or heterocyclic group; and
Q represents an aryl or heterocyclic group.
2. A compound according to claim 1 wherein the compound is of the formula:
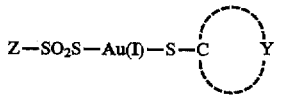
(II)
wherein Z is as defined in claim 1 and Y represents the atoms necessary for forming a 5 to 18 atom heterocyclic group.
* * * * *

UNITED STATES PATENT AND TRADEMARK OFFICE

CERTIFICATE OF CORRECTION

PATENT NO. : 5,686,236

DATED : November 11, 1997

INVENTOR(S) : Roger Lok, Weimar Weatherly White

It is certified that error appears in the above-identified patent and that said Letters Patent is hereby corrected as shown below:

Title page, Col. 1, [60]

delete "672,718" and insert -- 672,781 -- in its place and stead

Signed and Sealed this

Seventeenth Day of November, 1998

*Attest:*

Bruce Lehman

BRUCE LEHMAN

*Attesting Officer*

*Commissioner of Patents and Trademarks*